US007736085B2

(12) United States Patent
Neusch

(10) Patent No.: US 7,736,085 B2
(45) Date of Patent: Jun. 15, 2010

(54) BOLLARD SYSTEM

(75) Inventor: William H. Neusch, Marble Falls, TX (US)

(73) Assignee: Neusch Innovations, LP, Burnet, TX (US)

( * ) Notice: Subject to any disclaimer, the term of this patent is extended or adjusted under 35 U.S.C. 154(b) by 0 days.

(21) Appl. No.: 11/959,028

(22) Filed: Dec. 18, 2007

(65) Prior Publication Data

US 2008/0181721 A1 Jul. 31, 2008

Related U.S. Application Data

(60) Provisional application No. 60/870,486, filed on Dec. 18, 2006.

(51) Int. Cl.
*E01F 9/011* (2006.01)

(52) U.S. Cl. ..... 404/6

(58) Field of Classification Search ..... 404/6, 404/9–11; 49/33, 49, 131
See application file for complete search history.

(56) References Cited

U.S. PATENT DOCUMENTS

| | | | | | |
|---|---|---|---|---|---|
| RE26,779 | E | * | 2/1970 | Weichenrieder | 116/63 R |
| 3,564,769 | A | * | 2/1971 | Johnston et al. | 49/35 |
| 3,660,935 | A | * | 5/1972 | Boots | 49/35 |
| 4,003,161 | A | * | 1/1977 | Collins | 49/35 |
| 4,240,766 | A | * | 12/1980 | Smith et al. | 404/10 |
| 4,537,543 | A | | 8/1985 | Scott et al. | |
| 4,576,508 | A | * | 3/1986 | Dickinson | 404/6 |
| 4,658,543 | A | * | 4/1987 | Carr | 49/139 |
| 4,666,331 | A | * | 5/1987 | Riley | 404/6 |
| 4,711,608 | A | * | 12/1987 | Ghusn | 404/6 |
| 4,715,742 | A | * | 12/1987 | Dickinson | 404/6 |
| 4,919,563 | A | * | 4/1990 | Stice | 404/6 |
| 5,070,646 | A | * | 12/1991 | Colombo | 49/49 |
| 5,192,159 | A | * | 3/1993 | Higginson | 404/11 |
| 5,328,291 | A | * | 7/1994 | Wisniewski | 404/2 |
| 5,462,384 | A | * | 10/1995 | Arlandis | 404/6 |
| 5,474,017 | A | * | 12/1995 | Mohebbi et al. | 116/209 |
| 5,476,338 | A | * | 12/1995 | Alberts | 404/6 |
| 5,566,926 | A | | 10/1996 | Voigt | |
| 5,597,262 | A | | 1/1997 | Beavers et al. | |
| 5,829,913 | A | | 11/1998 | Puckett | |
| 5,908,262 | A | * | 6/1999 | Ahn | 404/9 |
| 6,099,200 | A | * | 8/2000 | Pepe et al. | 404/6 |
| 6,289,633 | B1 | * | 9/2001 | Lowe | 49/49 |
| 6,848,856 | B2 | * | 2/2005 | Johnson | 404/6 |

(Continued)

FOREIGN PATENT DOCUMENTS

DE 29606794 U1 * 7/1996

OTHER PUBLICATIONS

PCT/US2007/087934; International Search Report and Written Opinion mailed Jul. 2, 2009.

*Primary Examiner*—Raymond W Addie
(74) *Attorney, Agent, or Firm*—Henry L. Ehrlich; Winstead PC

(57) ABSTRACT

A bollard, which is positioned in a structure having a grade level, includes an outer member having a first section extending above the grade level; an inner member having a filler material; and a connector operationally connecting the inner member and the outer member, wherein the inner member straddles the grade level and is rotatable relative to the outer member.

19 Claims, 1 Drawing Sheet

U.S. PATENT DOCUMENTS

| | | | | |
|---|---|---|---|---|
| 6,997,638 | B2 * | 2/2006 | Hensley et al. | 404/6 |
| 7,128,496 | B2 | 10/2006 | Rogers et al. | |
| 7,134,804 | B2 | 11/2006 | Skalka | |
| 7,452,158 | B1 * | 11/2008 | Siu | 404/11 |
| 7,507,051 | B2 * | 3/2009 | McCue et al. | 404/9 |
| 2006/0153637 | A1 * | 7/2006 | Rogers et al. | 404/6 |
| 2006/0204327 | A1 | 9/2006 | Phelan | |
| 2008/0025792 | A1 * | 1/2008 | Jessop | 404/6 |

* cited by examiner

BOLLARD SYSTEM

RELATED APPLICATIONS

This application claims the benefit of U.S. Provisional Patent Application No. 60/870,486 filed Dec. 18, 2006.

TECHNICAL FIELD

The present invention relates in general to bollards and more specifically to a bollard system that includes a mechanism to deter efforts to disable the bollard as a physical barrier.

BACKGROUND

There has been a long-felt need to provide barriers to protect secured areas from encroachment by motor vehicles. These secure areas vary in size and purpose and include by without limitation, high pedestrian areas proximate to motor vehicle traffic, structures providing drive-through access, and approaches to structures. These secure areas also include road block situations such as border crossings and/or motor vehicle access areas. Unfortunately, in this era of increased terrorism and violence it is a desire to provide barriers in more locations and of sufficient strength and adaptability to deter and/or prevent numerous methods and means of unauthorized access. Commonly, bollards provide a physical barrier or deterrent to entry by a motor vehicle. However, bollard systems fail to provide a mechanism to prevent or deter the disabling of the bollard, for example by cutting, prior to an attempted impact breach.

SUMMARY

An example of a bollard, which is positioned in a structure having a grade level, includes an outer member having a first section extending above the grade level and an inner member rotatably positioned within the outer member.

Another example of a bollard, which is positioned in a structure having a grade level, includes an outer member having a first section extending above the grade level; an inner member having a filler material; and a connector operationally connecting the inner member and the outer member, wherein the inner member straddles the grade level and is rotatable relative to the outer member.

An example of a bollard, for installing into a structure with a portion of the bollard extending above ground level, includes an outer member and an inner member rotatably positioned within the outer member.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
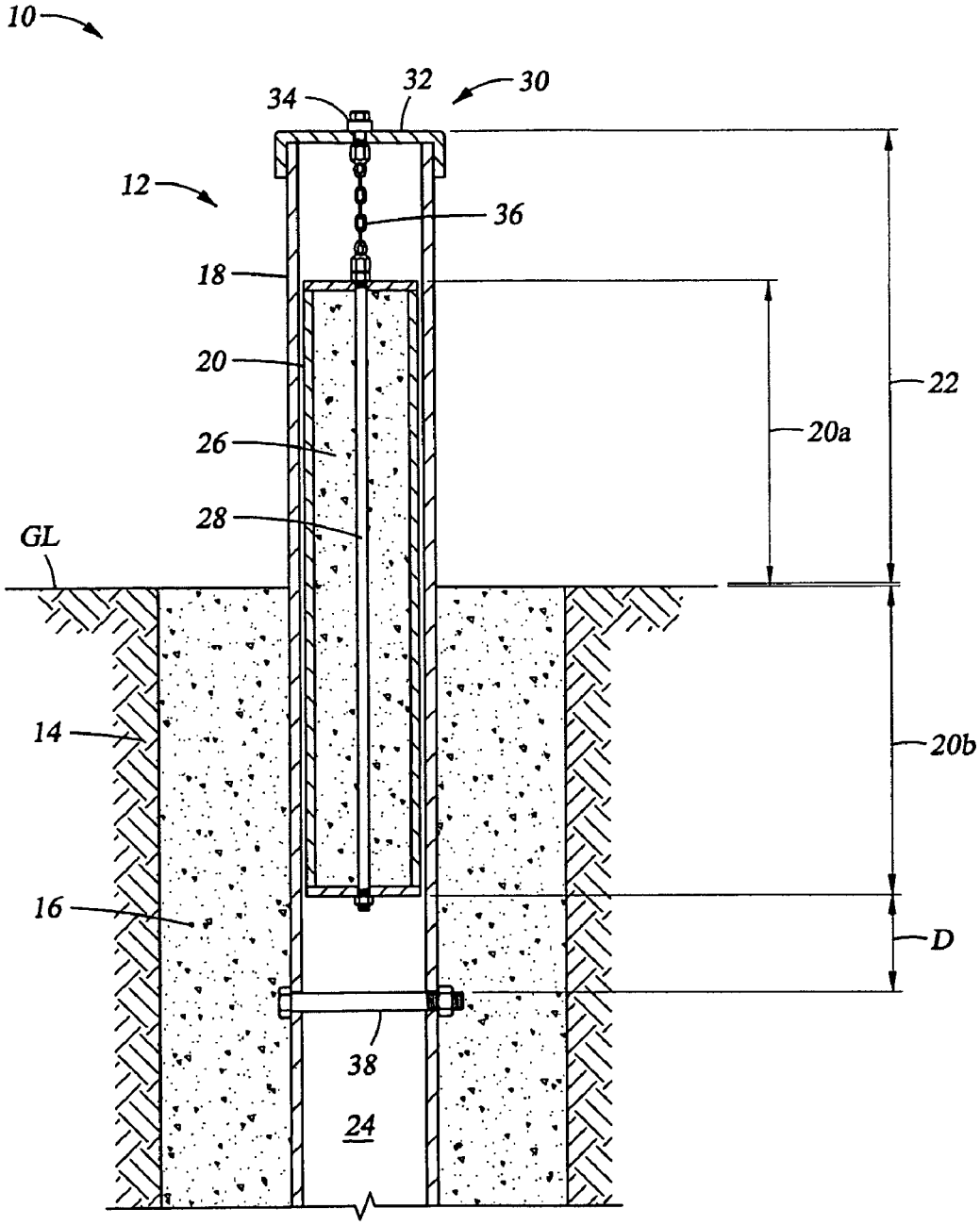
FIG. 1 is a conceptual view of an example of a bollard of the present invention.

Refer now to the drawings wherein depicted elements are not necessarily shown to scale and wherein like or similar elements are designated by the same reference numeral through the several views.

FIG. 1 is a conceptual view of an example of a bollard system of the present invention, generally denoted by the numeral 10. System 10 includes a bollard 12 mounted into a structure such as the ground 14 having a surface or grade level "GL". In the illustrated example, bollard 12 is secured in the ground by a subsurface support such as concrete. However, it should be recognized that bollard 12 may be driven into ground 14 or secured in various manners.

Bollard 12 is a double-walled structure that provides strength against impact and deterrence to tampering. Bollard 12 includes an outer tubular member 18 and an inner member 20. Outer tubular 18 may be constructed of any material to resist deformation upon impact from a motor vehicle, such as without limitation a metal pipe. Tubular 18 may have a circular cross-section or another geometric cross-section and may be referred to as a housing. The term tubular is utilized herein to include elongated members having an open interior or cavity. Outer tubular 18 includes an upper section 22 positioned above grade and a lower portion that is positioned below grade.

Inner member 20 may be constructive of various materials and for purposes of the illustrated example is constructed of a metal pipe. In the illustrated example, inner member 20 is includes a filler 26, which may provide reinforcement for bollard 12. In the illustrated example reinforcement is provided by the concrete filler 26 and reinforcement bars 28.

Inner member 20 is rotatably positioned within the interior 24 of outer member 18, so as to rotate or spin relative to outer member 18. Inner member 20 may be functionally connected to outer tubular 18 in various manners to allow for rotational movement of inner member 20 relative to outer tubular 18. For example, inner member 20 may be rotatably positioned in the earth and then outer tubular may be placed over it. Inner member 20 is connected to outer tubular 18 by an operational connector 30. Operational connector 30 is particularly adapted to deter destruction of bollard 12 by cutting. For example, if one were to attempt to cut through bollard 12 the process would be stopped or delayed by inner member 20 rotating upon contact of the cutting blade.

Various assemblies may be utilized as operational connector 30 to support and provide rotation of inner member 20 relative to outer tubular 18, it is noted that inner member 20 may not be physically connected directly to tubular 18. In the illustrated example, connector assembly 20 is a swivel type assembly including a support structure 32 carrying or serving as a swivel 34 and a link 36 interconnecting structure 23 and inner member 20.

In the illustrated example support structure 32 is as a cap, however it may be another type member such as a bar connected across tubular 18. Support structure 32 may further be positioned above or below inner member 20. Connecting link 36, such as a metal shaft, chain or other linking member, is connected via swivel 34 between cap 32 and inner member 20. Swivel 34 may include various mechanical devices or rotating connections. Swivel 34 may be provided at one or more locations such as, the connection between link 36 and cap 32, the connection between link 36 and inner member 20, and within a position on link 36. In the illustrated example link 36 is a chain connected to one of the reinforcing member 32. In the illustrated example, the provision of a connector assembly 30 forming a connection from the top of bollard 12 through inner member 18 maintains the subassemblies in connection when a disabling action is being attempted.

In operation, bollard 12 is installed within ground 14 or other structure such that upper section 22 is positioned above grade. Inner member 20 is rotatably positioned within outer member 18 so as to straddle the grade, illustrated by above grade portion 20*a* and below grade portion 20*b*. A stop 38 may be positioned below inner member 20 a distance "D" so as to maintain inner member 20 in an operational position if link 36 is parted. For example, if link 36 were cut, inner member 20 would rest atop stop 40 and still extend above grade GL. Without link 36 in operation, inner member 20 is swiveling connected to outer member 18 by stop 40. In effect, stop 40 serves as swivel connection 34. It should be noted that it may be desired for swivel assembly 34 to be positioned below the grade to further prevent tampering.

From the foregoing detailed description of specific embodiments of the invention, it should be apparent that bollard that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A bollard positioned in a structure having a grade level, the bollard comprising:

an outer member having a first section extending above the grade level; and an inner member rotatably positioned within the outer member, wherein the inner member is free to spin relative to the outer member whereby the rotatability of the inner member provides an anti-tamper feature.

2. The bollard of claim 1, wherein the inner member straddles the ground level.

3. The bollard of claim 1, further including a connector assembly rotationally connecting the inner member to the outer member.

4. The bollard of claim 1, wherein the inner member is substantially filled with a filler material.

5. The bollard of claim 1, wherein a filler material is concrete.

6. The bollard of claim 5, wherein the filler material further includes reinforcement bars.

7. The bollard of claim 2, further including a connector assembly rotationally connecting the inner member to the outer member.

8. The bollard of claim 2, wherein the inner member is substantially filled with a filler material.

9. A bollard positioned in a structure having a grade level, the bollard comprising:

an outer member having a first section extending above the grade level;

an inner member having a filler material; and a connector operationally connecting the inner member and the outer member, wherein the inner member straddles the grade level and is free to rotate relative to the outer member when the outer member is vertically stationary whereby the rotatability of the inner member provides an anti-tamper feature.

10. The bollard of claim 9, further including a stop member positioned below the inner member relative to the ground level a distance such that if the inner member rested a top the stop member a portion of the inner member extends above the grade level.

11. The bollard of claim 9, wherein the connector assembly includes:

a cap member connected to the outer member above the inner member relative to the grade level; and a connection link connecting the inner member to the cap in a spaced apart relationship.

12. A bollard for installing into a structure with a portion extending above the ground level, the bollard comprising:

an outer member; and an inner member rotatably positioned within the outer member in a manner such that the inner member is free to spin relative to the outer member when the outer member is vertically stationary whereby the rotatability of the inner member provides an anti-tamper feature.

13. The bollard of claim 12, wherein the inner member is substantially filled with a filler material.

14. The bollard of claim 13, wherein the filler material includes concrete and reinforcement bars.

15. The bollard of claim 12, wherein a connector assembly interconnects the inner member and the outer member in a manner such that the inner member rotates relative to the outer member.

16. The bollard of claim 15, wherein the inner member is substantially filled with a filler material.

17. The bollard of claim 15, wherein the filler material includes concrete and reinforcement bars.

18. The bollard of claim 15, wherein the connector assembly includes:

a support structure connected within the outer member; and a link connected between the support structure and the inner member.

19. The bollard of claim 18, wherein the link is a chain and further including:

a swivel connected with the chain; and a stop member positioned across the interior of the outer member on the opposite side of the inner member from the support structure.

* * * * *